US005884448A

United States Patent [19]

Pellock

[11] Patent Number: 5,884,448

[45] Date of Patent: Mar. 23, 1999

[54] TRUSS SPACER AND SUPPORT, METHOD OF USE AND STRUCTURES MADE THEREWITH

[75] Inventor: Michael A. Pellock, Edwardsville, Ill.

[73] Assignee: MiTek Holdings, Inc., Wilmington, Del.

[21] Appl. No.: 702,238

[22] Filed: Aug. 27, 1996

[51] Int. Cl.[6] ..... E04B 1/32

[52] U.S. Cl. ..... 52/643; 52/696; 52/713

[58] Field of Search ..... 52/643, 696, 697, 52/DIG. 6, 739.1, 720.1, 317, 712, 693, 694, 713

[56] References Cited

U.S. PATENT DOCUMENTS

| | | | |
|---|---|---|---|
| D. 293,416 | 12/1987 | Krueger | D8/373 |
| D. 318,785 | 8/1991 | Dean | D8/373 |
| 1,649,226 | 11/1927 | Gstalder . | |
| 1,685,729 | 9/1928 | Stone . | |
| 1,867,449 | 7/1932 | Ecket et al. | 52/317 X |
| 2,442,726 | 6/1948 | Gstalder | 20/9 |
| 2,964,807 | 12/1960 | Kennedy | 20/9 |
| 3,298,151 | 1/1967 | Jureit | 52/696 X |
| 3,873,221 | 3/1975 | Greenfield | 52/697 X |
| 3,959,945 | 6/1976 | Allen | 52/690 |
| 4,040,232 | 8/1977 | Snow et al. | 52/720 |
| 4,122,647 | 10/1978 | Kovar | 52/695 |
| 4,241,557 | 12/1980 | Jensen | 52/696 |
| 4,246,736 | 1/1981 | Kovar et al. | 52/696 |
| 4,308,703 | 1/1982 | Knowles | 52/696 X |
| 4,322,064 | 3/1982 | Jarvis . | |
| 4,361,999 | 12/1982 | Sidney | 52/696 |
| 4,455,805 | 6/1984 | Rionda et al. | 52/DIG. 6 X |
| 4,561,230 | 12/1985 | Rionda et al. | 52/DIG. 6 X |
| 4,604,845 | 8/1986 | Brinker | 52/696 |
| 4,637,195 | 1/1987 | Davis | 52/739.1 X |
| 4,669,235 | 6/1987 | Reinen | 52/98 |
| 4,704,829 | 11/1987 | Baumker, Jr. | 52/127.2 |
| 4,897,979 | 2/1990 | Colonias | 52/643 |
| 4,964,253 | 10/1990 | Loeffler | 52/643 X |
| 5,058,352 | 10/1991 | Loiselle et al. | 52/406 |
| 5,364,312 | 11/1994 | Cunard et al. | 52/712 X |
| 5,412,920 | 5/1995 | Hess | 52/712 |
| 5,423,156 | 6/1995 | Nellessen, Jr. | 52/715 |
| 5,606,837 | 3/1997 | Holizander . | |

OTHER PUBLICATIONS

USP Kant–Sag, Silver, Lumber Connectors, Plated Truss, p. 88, 1996 (304–961).

"HIB–91 Summary Sheet," Truss Plate Institute, Frames 1–6.

*Primary Examiner*—Lanna Mai

*Attorney, Agent, or Firm*—Armstrong, Teasdale, Schlafly & Davis

[57] ABSTRACT

A truss spacer and support device for installation between the chords of adjacent trusses includes an elongate, generally U-shaped channel member. There is a tongue on each end having at least one nail integrally formed thereon which is adapted to overlie the top of a chord with the integral nail embedded therein. Tabs extend from each side of the channel member at each end with at least one nail integrally formed thereon. The tabs are raked inwardly toward the opposite end sufficiently that the ends of the nails do not extend past the ends of the channel member sufficiently to interfere with positioning the device between the chord members of adjacent trusses. The tabs can be bent to overlie the sides of the chord, with their integral nails embedded therein. The devices are employed to accurately space and support trusses during construction of a structure, and to provide added support against in-service loads.

11 Claims, 4 Drawing Sheets

TRUSS SPACER AND SUPPORT, METHOD OF USE AND STRUCTURES MADE THEREWITH

BACKGROUND AND SUMMARY OF THE INVENTION

This invention relates to a truss spacer and support for use in correctly spacing trusses during construction, and for supporting the trusses during construction and thereafter.

Premanufactured wooden trusses greatly facilitate the construction of buildings and other structures. While these premanufactured trusses are very strong and reliable in service, during construction they can topple if they are not properly supported. Moreover to ensure that the trusses perform properly in service, it is important to make sure that they are properly spaced. Presently when trusses are used in construction they are placed in position and lateral braces are nailed across the top chords of the trusses to maintain the spacing and position of the trusses. As the trusses are tied together in the structure, for example by applying sheathing, the lateral braces are removed. This temporary attachment and subsequent removal of lateral braces is time consuming and thus expensive. Moreover, while this method of lateral bracing supports the trusses during construction, it obviously provides no support after the braces are removed.

Various attempts have been made to help properly space and provide temporary support for trusses during construction. See for example, Baumker, Jr. U.S. Pat. No. 4,704,829; Allen, U.S. Pat. No. 3,959,945; Dean, U.S. Pat. No. D 318,785; and Krueger, U.S. Pat. No. D 293,416. However, these have generally been elaborate devices that were too expensive and cumbersome to find practical application in the field. Moreover, these were typically temporary devices that had to be removed before construction was completed, with attendant labor costs, and thus they did not provide any post-construction support of the truss.

The truss spacer and support of the present invention helps provide accurate spacing between adjacent trusses, and helps support the trusses during construction to help prevent collapse of the structure while it is being constructed. It can be quickly and easily installed and does not require separate features. Moreover, the device can remain in place after construction, and thus provides additional support to the chords of the trusses, particularly against buckling forces.

Generally the spacer and support of the present invention is adapted to be installed between chords of adjacent trusses. The device comprises an elongate inverted U-shaped channel member having first and second ends. A tongue extends from each end of the channel member. Each tongue has at least one integrally formed nail thereon, and each tongue is adapted to overly the top of a chord member with the integral nail imbedded therein. A tab extends from each side of the channel member at each end. Each tab has at least one nail formed integrally thereon, and the tabs on each end are raked inwardly toward the opposite end sufficiently that the ends of the nails on the tabs do not project beyond the end of the channel member. The tabs are adapted to be bent to overlie the sides of the chord with their nails embedded therein.

The device can be quickly and securely attached to the chords of adjacent trusses without separate fasteners. The device accurately spaces the trusses, and supports the trusses during the construction process. The device has a low profile, and thus the devices can be left in place, so that they provide additional support to the chords in the trusses against buckling.

These and other features and advantages will be in part apparent and in part pointed out hereinafter.

BRIEF DESCRIPTION OF THE DRAWINGS

Corresponding reference numerals indicate corresponding parts throughout the several views of the drawings.

DETAILED DESCRIPTION OF THE PREFERRED EMBODIMENT

Figure 1:
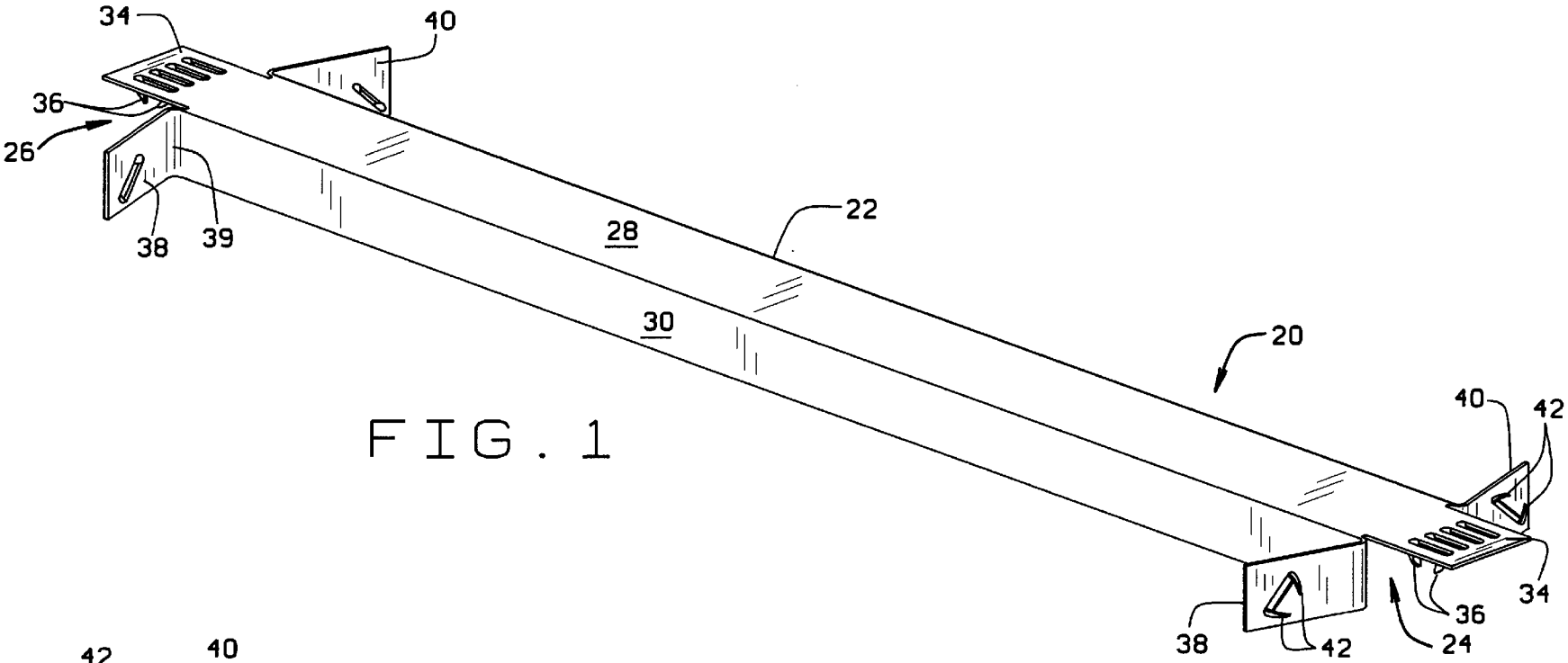
FIG. 1 is a perspective view of a truss spacer and support device constructed according to the principles of this invention.
Figure 2:
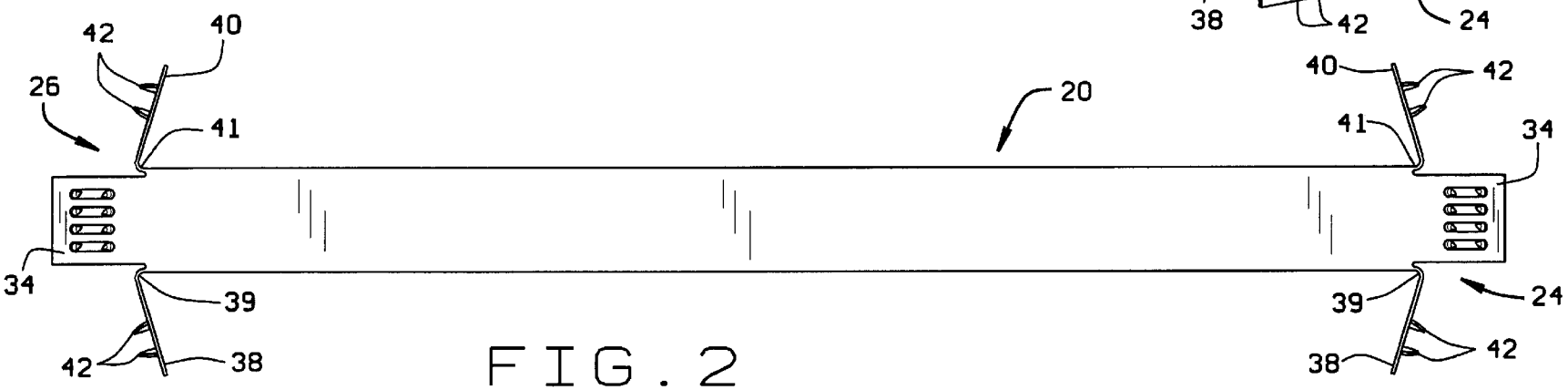
FIG. 2 is a top plan view of the truss spacer and support device.
Figure 3:
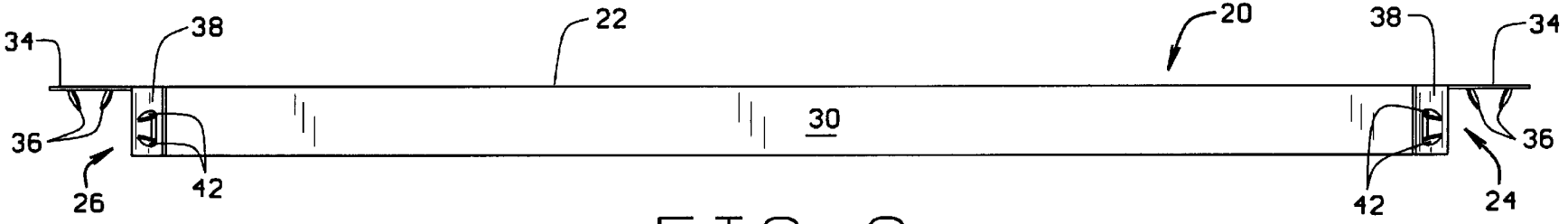
FIG. 3 is a side elevation view of the truss spacer and support device.
Figure 4:
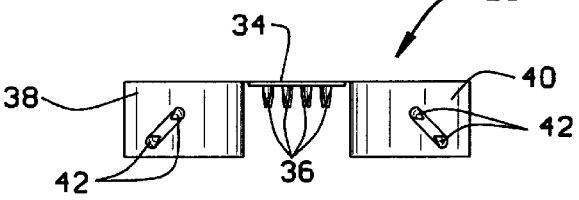
FIG. 4 is an end elevation view of the truss spacer and support device.
Figure 5:
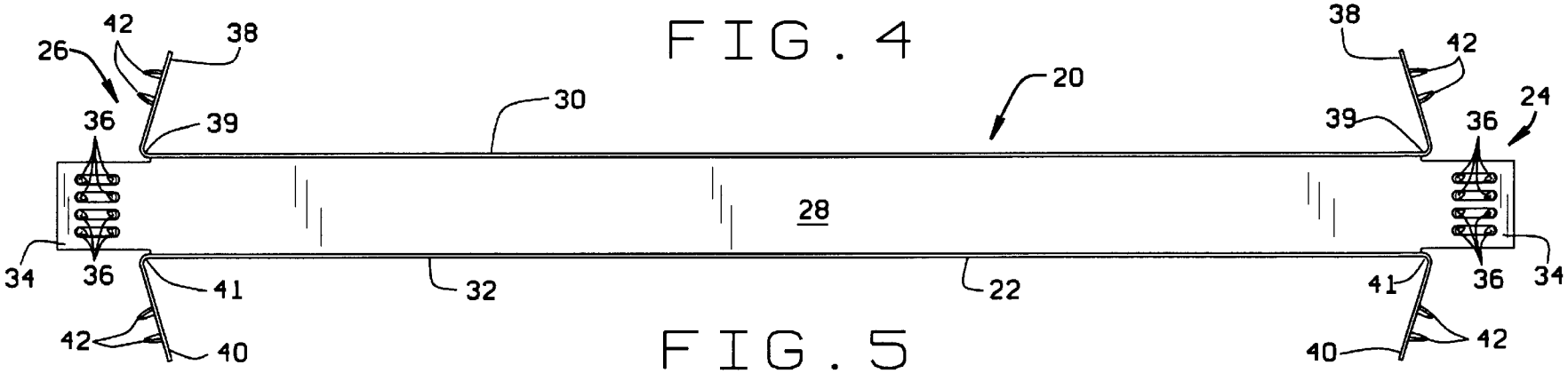
FIG. 5 is a bottom plan view of the truss spacer and support device.
Figure 6:
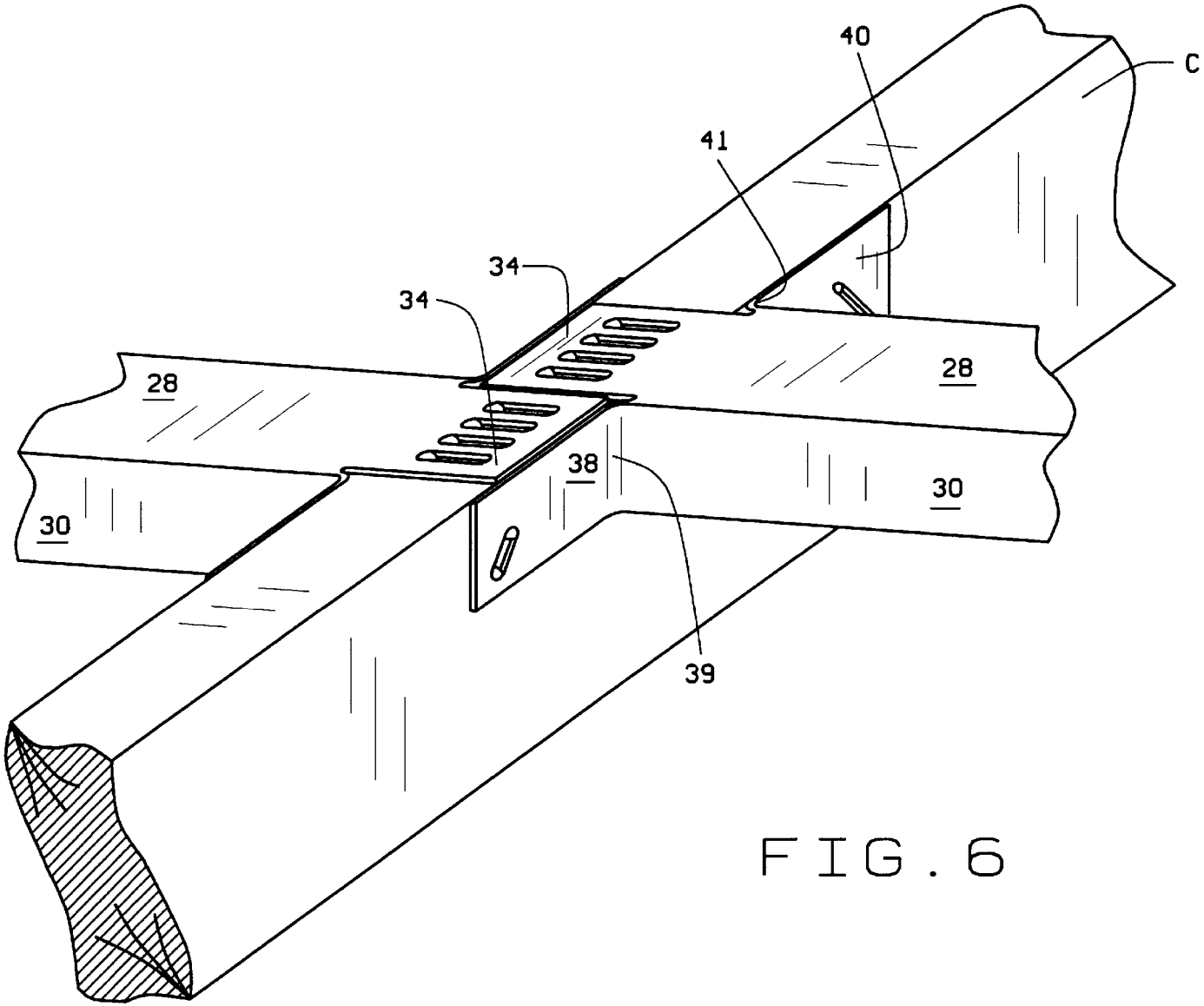
FIG. 6 is an enlarged perspective view of the end of a truss spacer and support device showing its attachment to the chord of a truss.

One embodiment of a truss spacer and support device constructed according to the principles of this invention is indicated generally as 20 in the Figures. The device 20 comprises an inverted U-shaped channel member 22 having first and second ends 24 and 26. The channel member comprises a base web 28 and side webs 30 and 32. A tongue 34 extends from the base web 28 at each of the ends 24 and 26 of the channel member 22. The tongue 34 is generally flat, and has at least one nail 36 formed integrally thereon, projecting from the underside of the tongue. In this preferred embodiment, there are four pairs of nails 36 projecting from the underside of each tongue. These nails 36 can be formed by conventional punching processes as is known in the art, which leaves a slot in the top of the tongue. The pairs of nails 36 are preferably staggered with respect to each other, to improve their ability to grip the top of a wooden chord member. As described below, the tongue 34 is adapted to overlie the top of a chord member in a truss, with the nails 36 embedded therein.

The device 20 also includes tabs 38 and 40 extending from each side of the channel member 22 at each of the ends 24 and 26. In this preferred embodiment, one tab extends from each side web 30 and 32 at each end, along fold lines 39 and 41, respectively, which permit the tabs to be bent relative to the channel member. The tabs 38 and 40 are preferably generally flat, and each has at least one nail 42 formed integrally thereon, projecting from the inner surface. In this preferred embodiment, there are a pair of nails 42 projecting from the inner surface of each tab. These nails 42 can be formed by conventional punching processes as is know in the art, which leaves a slot in the tongue. As shown in the Figures, the teeth are formed along a line that is 45° between vertical and horizontal, although the teeth could have some other orientation. The tabs 38 and 40 on each end of the device 20 are raked inwardly, toward the opposite end, so that the ends of the nails 42 do not project beyond the ends of the channel member 22 sufficiently interfere with the installation of the device between the chords of adjacent trusses. The tabs 38 and 40 are adapted to be bent along the fold lines 39 and 41 to positions perpendicular to the channel member 22 and parallel with the axis of the chord, to overlie the sides of the chord with the nails 42 embedded therein.

The device 20 is preferably made from 20 gauge galvanized steel. A different gauge steel, or some other suitable material could be used if desired.

The device 20 is adapted to be installed between chord members C and C' of adjacent trusses, such as premanufactured wooden trusses T and T'. The tongue 34 is positioned over the top of the chord C, with the end of the channel member 22 abutting the side of the chord C. The tongue 34 is then secured to the top of the chord C by driving the integral nails 36 into the top of the chord. The tabs 38 and 40 are then bent toward the side of the chord C, until they are generally perpendicular to the channel member 22 with the nails 42 embedded therein in the side of the chord. The other end of the device 20 is then secured to the chord C' of truss T' in the same manner. The chord C' of truss T' is adjusted to its correct position relative to the truss T, and the tongue 34 is positioned over the top of the chord C', with the end of the channel member 22 abutting the side of the chord C'. The tongue 34 is then secured to the top of the chord C' by driving the integral nails 36 into the top of the chord C'. The tabs 38 and 40 are then bent toward the side of the chord C' until they are generally perpendicular to the channel member 22, with the nails 42 embedded in the side of the chord.

The device 20 thus accurately spaces the trusses, and supports the trusses on each other during construction of the structure. The device 20 has a low profile on the tops of the chords so that the devices do not have to be removed, and can remain part of the structure during and after construction. Thus the devices help support the trusses in the completed structure, helping the chords to resist lateral flexing and buckling.

OPERATION

Figure 7:
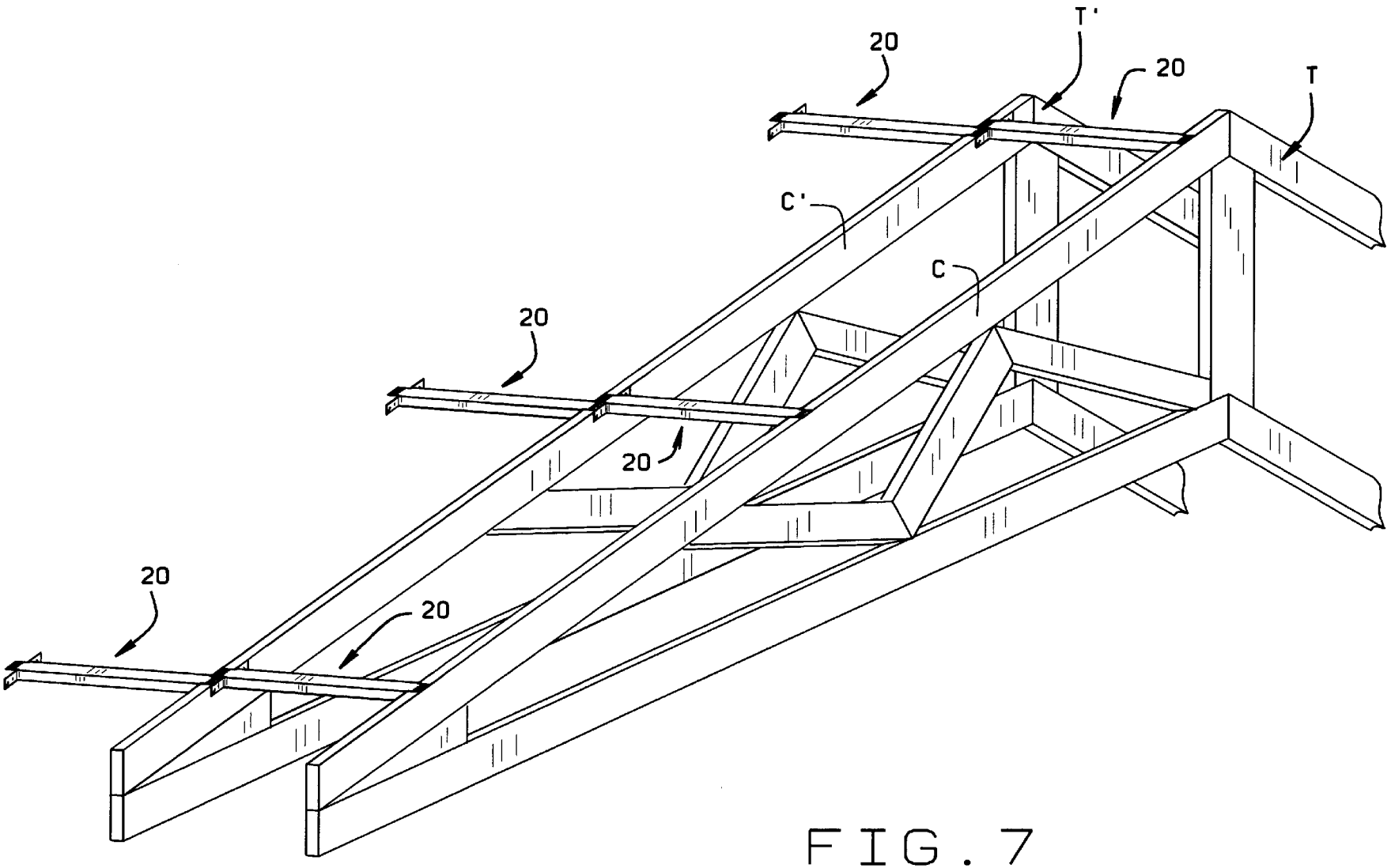
FIG. 7 is a side elevation view of a structure made from multiple trusses, illustrating the method of the present invention.

In operation, a truss T is put in its proper place and then one end of the device 20 is positioned on one side of the chord C of the truss, with the tongue 34 positioned over the top of the chord, and the end of the channel member 22 abutting the side of the chord. The integral nails 36 are driven into the top of the chord C, for example with a hammer. The tabs 38 and 40 on the end of the channel member 22 are then bent into engagement with the side of the chord, by driving the integral nails 42 into the side of the chord, for example with a hammer. The engagement of the tongue 34 with the top of the chord, and the engagement of the tabs 38 and 40 with the side of the chord, securely attaches the device 20 to the chord C. This process is repeated until there are several spacers and connector devices 20 extending laterally from the chords of the truss, as shown in FIG. 7.

A second truss T' is then positioned next to the truss T. The devices 20 help to accurately space the truss T' from the truss T. Once the truss T' is properly positioned, the free ends of the devices 20 are attached to the corresponding chords on the truss T'. The tongue 34 on the free end of each devices 20 is positioned over the top of the appropriate chord, with the end of the channel member 22 abutting the side of the chord. The integral nails 36 are driven into the top of the chord, for example with a hammer. The tabs 38 and 40 are then bent into engagement with the side of the chord, by driving the integral nails 42 into the side with a hammer. The engagement of the tongue 34 with the top of the chord, and the engagement of the tabs 38 and 40 with the side of the chord, securely attaches the device 20 to the chord. Once a plurality of devices 20 have been installed between trusses T and T', the trusses form a stable unit that is less prone to collapse during construction. The devices 20 have a sufficiently low profile that they do not have to be removed as the construction is completed, so the devices remain to help support the chords against in-service buckling loads.

Thus, the device of the present invention helps accurately space trusses during construction; stabilize the trusses during construction, and support the trusses after construction. The method of construction of this invention employing these devices help reduce the risk of collapse or failure of the trusses during construction, and structures made with the device have additional support against in-service loads, and particularly against buckling.

What is claimed is:

1. A truss spacer and support device for installation between chords of adjacent trusses, the device comprising:

an elongate channel member having first and second ends and a tongue extending from each end with at least one integrally formed nail thereon, the tongue adapted to overlie the top of a chord with the integral nail embedded therein; and tabs extended from each side of the channel member at each end with a nail formed integrally thereon, the tabs raked inwardly toward the opposite end sufficiently that the ends of the nails do not extend past the ends of the channel member, the tabs adapted to be bent to overlie the sides of the chord with their integral nails embedded therein.

2. The truss spacer and support device according to claim 1 wherein the channel member has a generally inverted U-shaped cross-section.

3. The truss spacer and support device according to claim 1 wherein the channel member has a generally inverted U-shaped cross-section, with a base web and opposing side webs depending from the base web, and wherein the tabs are connected to the ends of the side webs at a fold line.

4. The truss spacer and support device according to claim 1 wherein the integral nails on the tongues comprise at least one pair of nails punched from each tongue.

5. The truss spacer and support device according to claim 1 wherein the integral nails on the tabs comprise at least one pair of nails punched from each tab.

6. A structure comprising a plurality of preformed trusses each including a plurality of chords, and a plurality of truss spacer and support devices between adjacent trusses, each device comprising:

an elongate channel member having first and second ends and a tongue extending from each end and having at least one integrally formed nail thereon, the tongue overlying the top of a chord with the integral nail embedded therein, and tabs extending from the sides of the channel member at each end, each tab having at least one integrally formed nail thereon, the tabs overlying the sides of the chords with the nails embedded therein.

7. The structure according to claim 6 wherein the channel members have a generally inverted U-shaped cross-section.

8. A structure comprising a plurality of preformed trusses, each including a plurality of chords having upper and side surfaces, and a plurality of truss spacer and support devices extending between adjacent trusses, each said device comprising:

an elongated channel member having first and second ends, said channel member having a generally inverted U-shaped cross-section;

a tongue extending from each end of said elongated channel, said tongue comprising at least one integrally formed nail projecting therefrom, said tongue configured to overlie the upper surface of a chord with said integral nail embedded therein; and a tab extending from each side of said channel member at each end, each said tab having at least one integrally formed nail projecting therefrom, said tabs configured to overlie the side surface of the chord with said integral nail embedded therein.

9. A structure in accordance with claim 8 wherein said channel member comprises a base web and opposing side webs depending from said base web, said tabs coupled to each end of said side webs at a fold line.

10. A structure in accordance with claim 8 wherein said integral nails on said tongues comprise at least one pair of nails punched from each tongue.

11. A structure in accordance with claim 8 wherein said integral nails on said tabs comprise at least one pair of nails punched from each tab.

* * * * *